US012768108B2

(12) United States Patent
De Carvalho et al.

(10) Patent No.: US 12,768,108 B2
(45) Date of Patent: Oct. 20, 2026

(54) SYSTEM FOR CONTINUOUS TREATMENT OF CELLULOSE PULPS

(71) Applicant: Ricardo Reis De Carvalho, Valinhos (BR)

(72) Inventors: Ricardo Reis De Carvalho, Valinhos (BR); Ricardo De Lima Barreto, Valinhos (BR)

( * ) Notice: Subject to any disclaimer, the term of this patent is extended or adjusted under 35 U.S.C. 154(b) by 0 days.

(21) Appl. No.: 17/098,034

(22) Filed: Nov. 13, 2020

(65) Prior Publication Data

US 2021/0148051 A1 May 20, 2021

(30) Foreign Application Priority Data

Nov. 19, 2019 (BR) ..... 10 2019 024382 1

(51) Int. Cl.

| | |
|---|---|
| ***D21H 23/20*** | (2006.01) |
| ***D21C 5/00*** | (2006.01) |
| ***D21H 17/00*** | (2006.01) |
| ***D21H 17/20*** | (2006.01) |
| ***D21H 17/68*** | (2006.01) |
| ***D21H 21/22*** | (2006.01) |

(52) U.S. Cl.

CPC ..... *D21H 17/74* (2013.01); *D21C 5/005* (2013.01); *D21H 17/20* (2013.01); *D21H 17/68* (2013.01); *D21H 21/22* (2013.01); *D21H 23/20* (2013.01)

(58) Field of Classification Search

CPC ..... D21C 5/005; D21C 5/02; D21H 17/68; D21H 23/20; D21H 21/22; D21H 17/74; D21H 11/14; D21H 17/20; Y02W 30/64

USPC ..... 162/237

See application file for complete search history.

(56) References Cited

U.S. PATENT DOCUMENTS

| | | | | |
|---|---|---|---|---|
| 4,846,933 | A * | 7/1989 | Dreisbach | D21C 9/008 162/168.1 |
| 4,871,424 | A * | 10/1989 | Dreisbach | D21C 9/008 162/168.1 |
| 5,292,404 | A | 3/1994 | Hartan et al. | |
| 6,099,689 | A * | 8/2000 | Pruszynski | D21H 23/14 162/158 |
| 7,052,579 | B1 | 5/2006 | Wai | |
| 2004/0250971 | A1 | 12/2004 | Lopez | |
| 2005/0173088 | A1 * | 8/2005 | Grimsley | D21H 21/02 162/199 |

(Continued)

FOREIGN PATENT DOCUMENTS

| | | | |
|---|---|---|---|
| BR | PI0401695 | A | 1/2005 |
| CA | 2837676 | * | 12/2012 |

(Continued)

*Primary Examiner* — Abbas Rashid

(74) *Attorney, Agent, or Firm* — Intellectual Property Consulting, LLC; Jared Rovira

(57) ABSTRACT

This system is intended for paper and cellulose manufacturing process, in order to enable partial or full talc replacement in controlling pitch and stickies, in addition to helping in retention and drainage in paper and cellulose manufacturing processes. The chemical methodology and processes employed herein primarily involve the mix of adsorbent clays such as bentonite and hydrotalcite in the form of a slurry mix, obtained through a thermodynamic equipment called continuous flow shearing chamber (502), which provides delamination in pressure and temperature conditions, able to enhance the exposure of adsorption sites.

11 Claims, 9 Drawing Sheets

(56) References Cited

U.S. PATENT DOCUMENTS

| | | | | |
|---|---|---|---|---|
| 2009/0229775 | A1* | 9/2009 | Zhang | C08K 3/346<br>162/164.1 |
| 2017/0174533 | A1* | 6/2017 | Gantenbein | B01J 20/28004 |

FOREIGN PATENT DOCUMENTS

| | | | |
|---|---|---|---|
| CN | 101333787 | A | 12/2008 |
| CN | 109331774 | A | 2/2019 |
| EP | 1475476 | A1 | 11/2004 |
| WO | WO01/71092 | A2 | 9/2001 |
| WO | WO03/085199 | A2 | 10/2003 |
| WO | WO2008/077877 | A2 | 7/2008 |
| WO | WO2009/117073 | A1 | 9/2009 |

* cited by examiner

SYSTEM FOR CONTINUOUS TREATMENT OF CELLULOSE PULPS

CROSS REFERENCE TO RELATED APPLICATIONS

The present application claims priority to Brazilian patent application No. BR 10 2019 024382 1 filed Nov. 19, 2019, which is incorporated herein by reference in its entirety.

FIELD OF APPLICATION

This Invention Patent application refers to the field of paper and cellulose manufacturing. More specifically, this application relates to a system for continuous treatment of cellulose pulps through a method and process capable of reducing, or even eliminating, the use of talc in manufacturing paper and cellulose. This system involves a mix of clays in special conditions capable of enhancing its adsorbent properties, associated or not to other chemical strategies, in order to remove dissolved contaminants and colloids and, in addition, improve retention and drainage properties with expected gains in sheet formation and drying phases.

Preamble

This Invention Patent application more specifically describes an application system for mixing natural and synthetic clays in a thermodynamic equipment comprised of a continuous flow shearing chamber, under temperature and pressure, which provides the mixing of bentonite and hydrotalcite slurries, among other clays, in different ratios, with a subsequent increase in surface area and adsorbent capacity of clays, in addition to the optional addition of fixing polymers or biopolymers in different application points in order to retain fines, fibers and loads, either associated or not to a surfactant-based chemical dispersing agent and supplementary enzymatic action (lipase or esterase).

The clay mix so obtained may be applied along with talc, for partial or full replacement, depending on the desired removal level of contaminants and improvement goals for retention and drainage for subsequent phases of mass preparation, more specifically sheet formation and drying phases.

The control of deposits is invaluable for the efficiency of the paper and cellulose manufacturing process (Rojas, O. J. et al., 2006), preventing carriage with the pitch and sticky materials, as they are called in the paper manufacturing industry, which may gather inside the suction boxes, formation screens, felt and pressing rolls, even reaching up to the drying section. In addition to losses related to runnability (higher machine speed and stability), there are extreme cases of production losses caused by stoppages for cleaning felts or due to sheet breaking, in addition to inherent quality-related problems, such as stains and small holes on the paper sheet.

The pitch basically comprises natural contaminants from the wood (e.g.: resinous acids, steroids, waxes, etc.) while stickies come from recycled fibers and, therefore, are synthetic substances such as glues, adhesives, latex, among others. The challenge arises when said clusters of contaminants appear at the micrometric range, more specifically below 5 μm, which is the limit for conventional physical purification methods such as filters, sieves, washers, and flotation systems. In such cases, in which the species are dissolved or in colloidal state, more specific chemical control methods must be applied, such as use of adsorbents, fixatives, dispersing agents, surface passivation agents and hydrolytic enzymes.

Among available methodologies, the use of adsorbents such as talc is particularly interesting, since it acts both as an adhesion inhibitor for contaminants (detackifier), thus preventing agglomeration and formation of deposits, and as a fixative specially when associated to polymers, comprising an effective retention and drainage system that allows removal from the system along with the fibers, at no effect to the end quality of the paper.

More recently, concerns emerged regarding the presence of talc on paper products, particularly adsorbent papers with a higher degree of contact with the final customer. In this sense, it is known that company Johnson & Johnson submitted technical inquiries regarding the safety to human health due to the presence of asbestos (carcinogenic material) in its composition, which led to a motion from some manufacturers in order to gradually replace the use of talc in the paper manufacturing process.

STATE OF THE ART

This Invention Patent application entails knowledge acquired in the field contextualized above, evidencing technological advancements with special mentions to the most relevant aspects of the aforementioned talc replacement process, both in controlling pitch and stickies, and acting in retention and draining of the damp ends of paper and cellulose machines.

An interesting parallel in the pitch control area is found at the beginning of the 1990 decade, in which the challenge was overcome with the technology provided on document U.S. Pat. No. 5,292,404, when an important change in process pH took place, enforcing the need for replacing aluminum sulfate as a coagulant for "anion garbage" with cationic polymers for flocculation of said deposits, such as quaternized acrylamides.

Advances in amplifying the range of polymers as pitch control agents were observed in the following years, although a few specific deposits, such as "white pitch" that contains latex, are not prevented solely by using polymers and/or talc, thus requiring more complex chemical systems. Precisely at this point, technologies comprising microparticle systems with bentonite are applied in combination with polymers and polysilicates (WO 03/085199), in addition to the use of biopolymers such as xanthan gum (WO 01/71092) and whey protein (U.S. Pat. No. 7,052,579).

In fact, the use of microparticles containing bentonite and polymers goes beyond pitch control and has been used as a retention and drainage agent for some time. In this sense, attention in particular is drawn to advancements proposed in a Chilean patent (CL 2002002155) extended to the United States (US 20040250971), Europe (EP 1475476) and some other strategic countries in the paper industry, such as Brazil (PI 0401695). The difference is due to the possibility of applying a bentonite dispersion at concentrations higher than 5% (never went higher than 5% previously), in low dosages (lower than 1,000 g/t of dry pulp), with no need for complex application systems and in different points of the process, featuring effective results even in the absence of polymers.

Intrigued by this brutal difference in performance among bentonites, it was found that its flocculation and adsorbent properties are extremely variable, thus affecting its role in pitch control, load and fiber retention and improving the drainage behavior during the sheet forming process. Patent WO 2008/077877 was decisive in unveiling the most recent evolution in processing raw bentonite, in order to attain the best performance in these applications. In summary, it was found that the best bentonites are the calcitic ones, with a high concentration of montmorillonite, in stable slurry (around 10% suspension) through a wet milling process with temperatures around 50 to 80° C. The activation of this bentonite was provided with calcium and magnesium salts, in addition to a combined talc application, improving its properties.

Patent WO 2009/117073 considers a mix of clays in the form of slurries, including talc itself in order to tackle the problem with organic deposits in paper and cellulose, but limited to compound silicate clays (e.g.: Kaolin, bentonite, etc.), always associated to a hydrophobic ether-type modified cellulose polymer and, alternatively, a surfactant.

Also regarding application of talc in combination with other additives for pitch and stickies control, it was found in WO 2014/195478 that the use of a mix of oxides and hydroxides of alkali earth metals to improve bleaching efficiency. In addition to talc, other additives such as bentonite, diatomite, zeolite, among other adsorbents, may be applied to different points of the process, either mixed or individually, in the form of slurries, spray-dryer or pelletized.

In the search for new alternatives of adsorbent materials for replacement of talc in pitch control, in addition to other previously mentioned conventional choices, a Chinese patent was found (CN 101333787) that employs materials of the hydrotalcite type (natural or synthetic clay) as an adsorption and fixation strategy when associated to a cationic polyacrylamide, in order to gain sheet retention in addition to removal of resinous contaminants.

Upon deeper research in the preparation processes for hydrotalcite with other adsorbent materials, a recent Chinese patent was identified (CN 109331774) which attains a modified bentonite, reacting it with hydrotalcite under pressure and temperature in order to increase its surface area and adsorption points focused on removal of heavy metals and dyes.

Problems of the State of the Art

It was previously stated, regarding the State of the art of this Invention Patent application, that most current technical solutions for partial or full talc replacement involve microparticle systems with adsorbent action similar to talc, employing different natural clays such as powdered bentonite (an example is seen in patent WO 03/085199), although the vast majority is within the same chemical class of silicates.

It should be highlighted, however, that every clay features inherent structural characteristics of the application, so that bentonite specifically has a hydrophilic characteristic and an exfoliation capacity that is significantly higher than talc, featuring an even higher susceptibility to the ionic character of the medium. Therefore, in addition to good affinity with colloidal contaminants (pitch and stickies), it also features a higher affinity than talc with cationic polymers that form crossed bonds with fibers and fines, more significantly affecting retention and drainage properties, which, in turn, may potentially harm the paper's damp chemistry balance. Therefore, the use of associated polymers or biopolymers (seem in patents WO 01/71092 and U.S. Pat. No. 7,052,579) is basically a premise of this type of application. For this reason, it is understood that a full talc replacement, in such cases, is unfavorable, as may be seen in practice in many applications that maintain their combined application or in various points of the paper and cellulose manufacturing process.

In addition to differences in chemical nature of the various types of bentonite which are directly related to efficiency in removal of contaminants (WO 2008/077877 shows primary differences), another aspect of bentonite that deserves mention refers to the powder application form, which is much more operationally complicated, in addition to increased exposure to human health risks due to the likelihood of inhaling suspended particles. This type of limitation was approached on patent CL 2002002155 with the application of stabilized bentonite in slurry form, although it is restricted to the application of a single bentonite-based clay type.

Such limitation in the chemical action of adsorbents was approached in patent WO 2009/117073, which provides a clay mix, in addition to the application in slurry form. However, the patent falls short when it only covers clay mixes of the same chemical class as talc (all silicates, such as bentonite and kaolin) and refrains from exploring possible synergies with other clay types, maintaining the limitation of combined application with a polymer or biopolymer (in this case, a modified cellulose ether) in order to preserve the balance of the retention and drainage system, presenting difficulties in full talc replacement.

In general, very few works have submitted alternatives to silicate-type clays, with a special mention to Chinese patent CN 101333787, which approaches new hydrotalcite-type clays in pitch control due to their marked lipophilic (compared to silicate-based clays) and adsorption properties. However, this work is focused on retention, particularly when hydrotalcite is associated with polyacrylamides and features no synergy action when mixed with other clays.

Based on the aforementioned problems, upon a detailed analysis carried out in order to propose the subject herein, none of the pitch and stickies control applications, retention and drainage or preparation methods of materials provided in the state of the art are in conflict with the implementations described in this Invention Patent application, which is primarily based in a mix of clay slurries, particularly natural bentonite and synthetic hydrotalcite, with significantly improved adsorption properties of dissolved and colloidal contaminants due to the combined application and synergy action through a continuous flow shearing chamber, or with no talc addition, as well as other applied chemical methodology and process methods.

Lastly, considering the scope of the patent survey featured herein, no other processes related directly to the aforementioned subjects in the INPI [Brazilian Patent and Trademark Office] archive and main worldwide patent offices were found.

BRIEF DESCRIPTION OF THE INVENTION

As per the following detailed description, this Invention Patent application provides a system for continuous treatment of cellulose pulps, for control of pitch and stickies dissolved and colloidal contaminants, in addition to gains in sheet retention and drainage.

The method and process that substantiate this Invention Patent application, when compared to those reported in the state of the art, provide extensive benefits in paper and cellulose manufacturing, as per the principles listed below:

- Full or partial talc replacement in paper and cellulose manufacturing processes. Depending on the amount of hydrotalcite used in the clay mix, due to its synergy action with silicates and adsorption properties increased in the system application, a 50%, 90% or even 100% talc reduction may be provided, which would be unlikely to be reached by using only silicate-type clays, such as bentonite. The "unique" property of talc within the silicate class should also be highlighted, an "organophilic surface" with a high affinity towards organic contaminants, while its "hydrophilic corners", at the same time, enable good dispersion in water, thus explaining the great difficulty in finding a straightforward replacement;

New clay composition (natural and synthetic) with complementary and synergic adsorbent properties. It was seen that hydrotalcite is a peculiar clay type, as well as talc, since it also features an organophilic property with high adsorption capacity, in addition to supplementary action on bentonite due to its "positive lamellar structure, stabilized by negative counter-ions (e.g. Carbonate or sulfate), while bentonite features a "negatively charged crystalline structure", maintaining balance of unit cells and cations (e.g. Sodium and calcium bentonite);

Use of stabilized slurries, for easier transport and handling on the field. Formulations capable of maintaining solid and concentrated slurries (mass relation between 10% and 50%) in order to avoid the logistic cost of water transportation. In addition, slurry may be pumped, which facilitates the pressurized intake to the application system and avoids applying powder which is harmful to human health;

New thermodynamic equipment for slurry mixing through a continuous flow shearing chamber which provides flexibility in varied clay and bentonite applications in different ratios (varied hydrotalcite and bentonite mass ratios, ranging from 1:1000 to 1000:1), under adjustable pressure and temperature according to flow rate and concentration of equipment inlet slurries;

In addition to the flexibility in application, the continuous flow shearing chamber is also responsible for increasing "clay delamination", and subsequent increase in surface area and adsorption sites, also enabling the combination of adsorbents with other chemical methods that involve combined addition of in different application points of polymers/biopolymers, dispersing agents and hydrolytic enzymes.

BRIEF DESCRIPTION OF THE DRAWINGS

This Invention Patent application will be described in detail with reference to the drawings listed below, in which:

FIGS. 2A and 2B include charts showing the efficiency of removal of pitch and stickies by different methodologies for counting contaminants, while FIG. 2A is specific for adsorbents through turbidity measurement, and FIG. 2B is applicable to polymers and dispersing agents through microscopic counting of contaminants;

DETAILED DESCRIPTION OF THE INVENTION

Considering that the core of this Invention Patent application is a continuous treatment system for cellulose pulp based on a chemical method and processes for clay mixing in special conditions, in order to remove dissolved and colloidal contaminants, in addition to improvements in retention and drainage, the main technological advancements are described below, which also characterizes this patent application.

Figure 1:
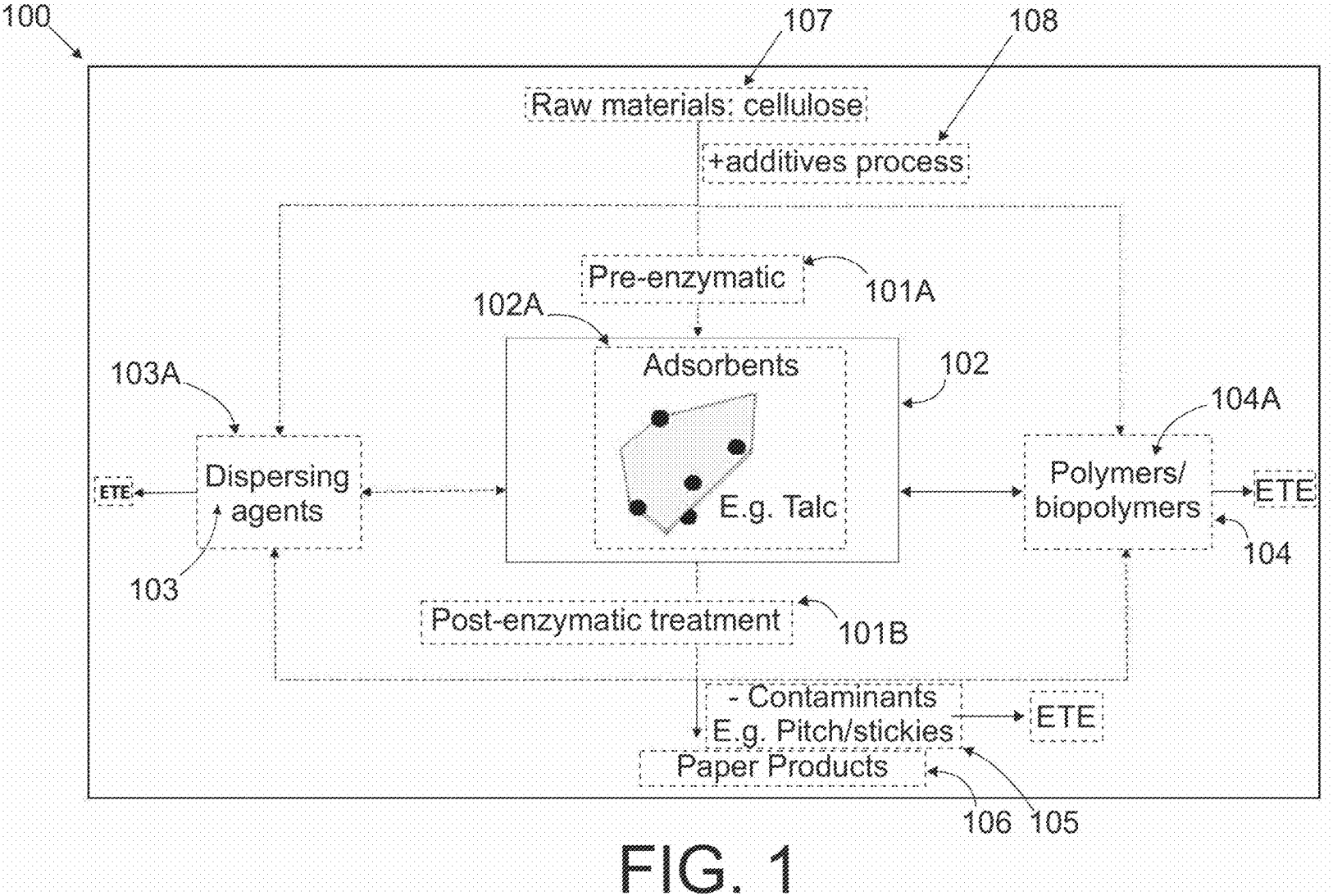
FIG. 1 shows the chemical methodology to be employed in order to approach the talc replacement problem.

Initially, through the schematic representation shown in FIG. 1, the chemical method 100 is presented, which may be comprised in this invention when approaching the problem of partial or full talc replacement in paper and cellulose manufacturing processes.

The basis of the proposed strategy is the chemical adsorption method 102 which features the most significant results when applied individually (talc is classified as an adsorbent). In general, adsorbents in FIG. 1 are indicated as 102A. Other two associated methods 103 and 104 should ideally be observed, which provide the use of dispersing agents 103A (in method 103) prior to adsorption in order to maximize the amount of colloidal contaminants and, afterwards, the addition (in method 104) of a polymer or biopolymer (preferably cationic, with specific chemical functions and chain size), indicated as 104A to favor the fixing of dissolved and colloidal contaminants (pitch and stickies), loads and fiber fines.

Still regarding the diagram in FIG. 1, raw materials (cellulose) 107 are shown, as well as the representation of process 108 additives also comprised in the chemical methodology.

It should be understood that dispersing agents, polymers and biopolymers mentioned are the standard substances used in the State of the Art, considering the optimal dosages of applications easily recognized by area experts, but always associated to the mix of adsorbent clays proposed herein, in slurry form and applied via the system for continuous treatment of the cellulose pulp, which will be described in more detail below.

Another previously mentioned aspect which requires emphasis, considering the main focus of this invention as the full or partial talc replacement, refers to the challenge in obtaining an "alternative adsorbent system" with properties as unique as those of talc, whose layers feature an "organophilic" surface and the corners are "hydrophilic", granting dispersibility in water medium associated to a dual action, both as a fixing agent and as a detackifier.

The fact is that direct replacement by other silicate-type adsorbent agents such as bentonite cannot fulfill the expected overall performance, thus preventing full process removal. In such cases, the use of associated methods (dispersing agents and polymers) is vital for mitigating the effects of its absence. The only way to attain this, as proposed in this invention Patent application, is through the use of a new clay mix, with a synergic and supplementary action, such as the adsorption system that involves the combined application of hydrotalcite and bentonite in an ideal ratio, in which the organophilic and hydrophilic properties are better balanced and closer to the action of talc alone, not to mention the adsorption capacity highlighted by the increase in surface areas due to forced delamination within a continuous treatment system that provides high shearing rates.

In a complementary approach to the methods above, a pre-enzymatic treatment 101A may also be deployed, capable of facilitating the release of synthetic fiber contaminants (e.g. esterase), associated or not to a post-enzymatic treatment 101B which provides the use of lipases for degrading glycerides commonly found in pitch. It should be noted that the application of associated dispersion methods through dispersing agents 103 (surfactants) and fixing polymers or biopolymers 104 may be alternated, before or after the main adsorbents 102. Another point of emphasis is that contaminants 105 are ultimately eliminated from the manufacturing process via the Effluent Treatment Station (ETE 1 Estacao de Tratamento de Efluentes) or carried along in the fiber with the product, are retained or, more specifically, "concealed" in the paper products 106.

In fact, it should be understood that pitch and stickies-type contaminants are retained (or concealed) on the surface of adsorbents which also end up acting as "inert charge", granting a monetary advantage which is the "aggregate weight" to the sheet, neither affecting its physical or chemical properties, nor represent any type of risk to human health, except for recent problems likewise related to talc composition including asbestos, which is acknowledged as a carcinogenic material, thus reinforcing the current movement towards replacement. Alternatively, for fixation mechanisms, said contaminants may also bond in the cellulose fiber through cross bonds with polymers or biopolymers.

Figure 2A:
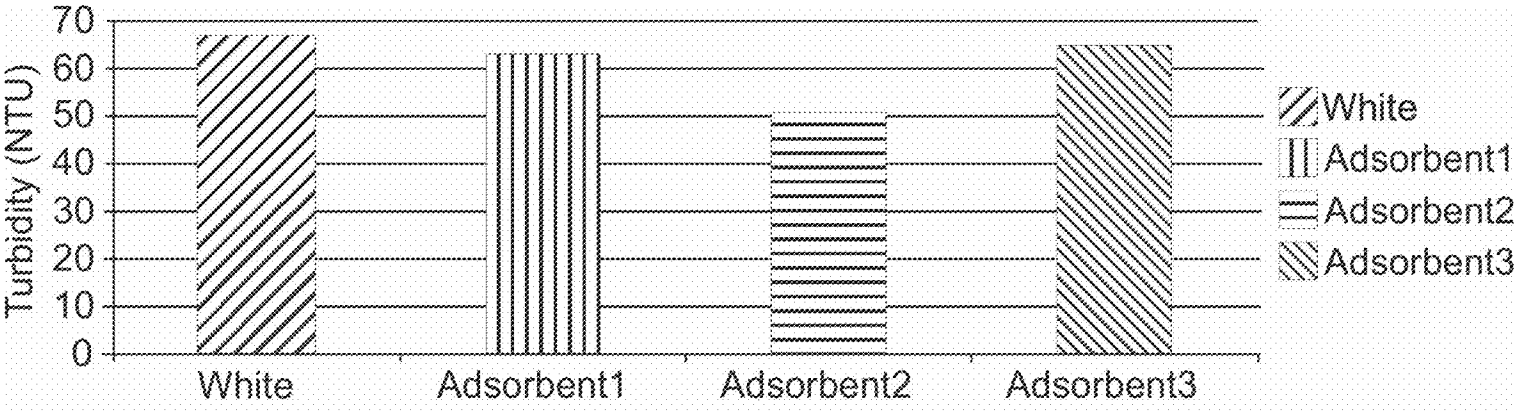
Figure 2B:
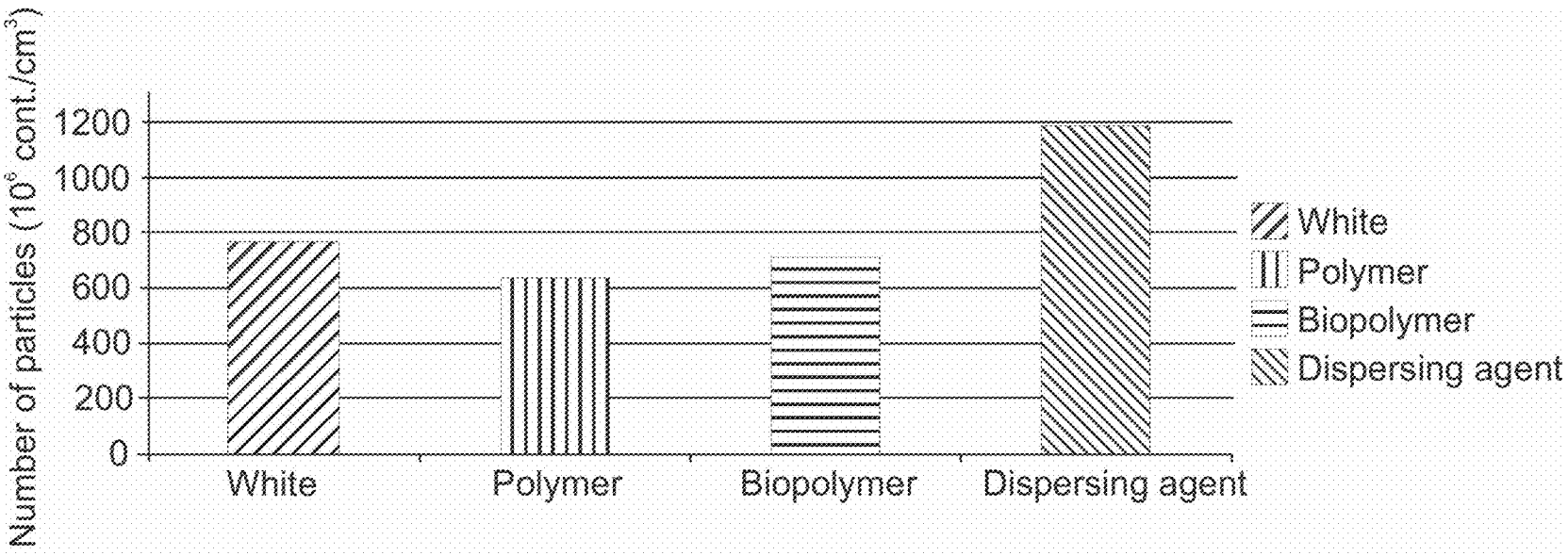

The chemical action of different methodological approaches may be observed in examples 1 and 2 detailed below, which measure the removal efficiency of dissolved and colloidal contaminants by adsorbents through reduction of turbidity in a simulated sticky sample (FIG. 2A) or, for polymers, biopolymers and dispersing agents, through microscopic counting of contaminants in an actual pitch sample (FIG. 2B). Specifically in this case, it should be noted that polymers and biopolymers reduce the amount of contaminants due to its fiber fixation properties, whereas dispersing agents have the opposite effect, increasing the amount of contaminants, but in reduced sizes.

EXAMPLE 1. For simulating stickies, a standard label (PIMACO brand) was cut in 0.5×0.5 cm pieces, up to 30 g of weight, and 970 g of tap water was added, letting it soak for 4 hours. Afterwards, the pieces were initially shredded in a blender for 90 seconds, and transferred to the fiber pulper at 10,000 RPM. The sample was filtered in a black band filter paper (7.5 μm pore) to remove the fibers. 50 g of the filtered solution was collected, adding 4 Kg/t of adsorbent products (e.g. Talc, bentonite and hydrotalcite), initially at a 1% solution. It was then stirred for 15 minutes, transferred to a tube, and centrifuged at 500 G for 5 minutes. Afterwards, the supernatant was transferred carefully to a beaker and turbidity readings were carried out. Lastly, the sample was acidified to a pH near 4.00 using a 0.5% H2SO4 solution, and a final turbidity reading was carried out.

EXAMPLE 2. A 50 g mass of the pitch-rich cellulose pulp sample was collected, adding 4 Kg/T of products to be tested (e.g. Polymers, biopolymers, and dispersing agents), from a 1% solution. The sample was stirred for 15 minutes and filtered in a 32 MESH sieve for retention of the "coarse" of the cellulose mass, subsequently filtered in black band filter paper for retention of fines. The sample was mechanically stirred (240-280 RPM) for 15 minutes. Afterwards, the sample was filtered with a black band filter, and the filtered product was diluted at a proportion of 100 μL of sample to 900 μL of distilled water. For contaminant counting, a maximum of 100 μL was deposited in the interstices formed between the slide and the Neubauer chamber as to avoid overflowing. The counting was carried out in an optical microscope with 1000× final amplification lenses, focusing the 0.050 mm long grades placed at the center of the mirrored part and counting the characteristic pitch points, scanning the entire height between the bottom of the Neubauer chamber (focused grade) and the glass slide, for a total of 2.5×10−7 $cm^3$ in volume.

After the best chemical methodology is determined, alternatively comprising one or more associated methods, and supplementary to the adsorption, dosage points must be chosen while considering talc replacement. As for the typical case of the cellulose manufacturing process 300 (diagram shown in FIG. 3), starting at the continuous digester 301, followed by pulp purification 302, the fractioned dosage of talc (or substitute adsorbent system) is seen immediately after the filter section 303 and press section 304. However, the association of other methods may also be provided, such as dispersing agents also at the filter section 303, fixation polymers or biopolymers after the press section 304 or after storage 306, avoiding the diffusers 305 and purifiers 307 where application is made difficult. There is also the complementary method that involves hydrolytic enzymes prior to reaching the drying machine 308.

At first, this invention, which provides a mix of clays from the hydrotalcite and bentonite types, applied in slurry form through a continuous treatment system of the cellulose pulp with high shearing rates, should be enough to address the problem of dissolved and colloidal contaminants in the fiber line in talc replacement; however, depending on the level of contaminants and specific retention and drainage goals, associated and complementary methods involving surfactant dispersing agents, polymers, biopolymers and enzymes may be used in combination, and are familiar to those skilled in the art.

Figure 3:
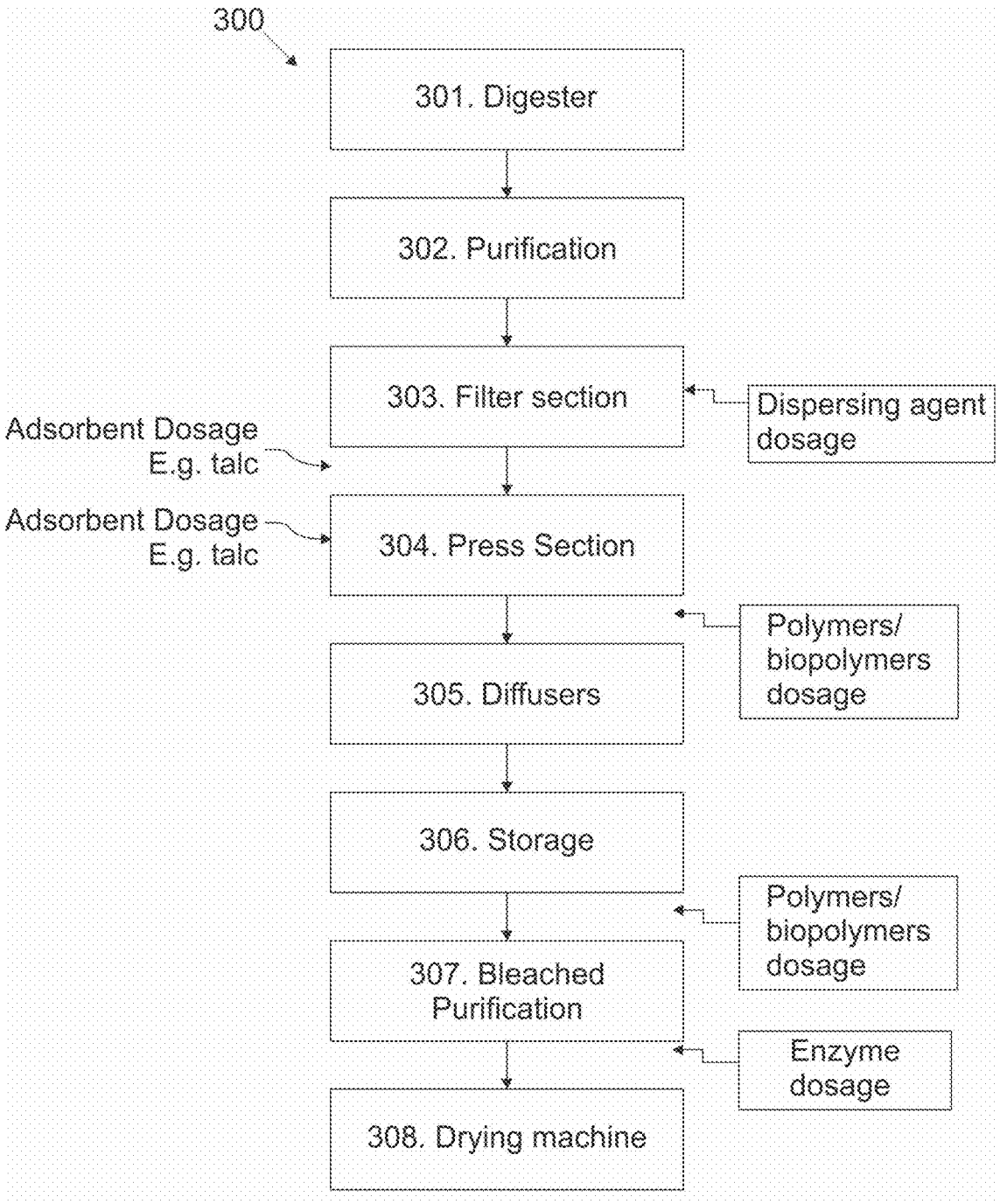
FIG. 3 shows a diagram illustrating the main adsorbent application points (e.g. Talc), associated and supplementary methods in a typical cellulose manufacturing process, such as the one proposed in this patent application.

Specifically as show in FIG. 3, the typical cellulose manufacturing process 300 comprises, in sequence, a phase in a continuous digester 301; a purification phase 302; a filter section phase 303, and another filter section phase 304; a diffuser section 305 followed by the storage phase 306, sequentially followed by the bleached purification phase 307 and, lastly, the drying machine phase 308; a dispersing agent dosing phase is provided on phase 303; an adsorbent dosing phase (e.g. talc) between phases 303 and 304; an adsorbent dosing phase (e.g. talc) at the press section 304; a polymer/biopolymer dosing phase between phases 304 and 305; another polymer/biopolymer dosing phase between phases 306 and 307; and an enzyme dosing phase between phases 307 and 308.

Figure 4:
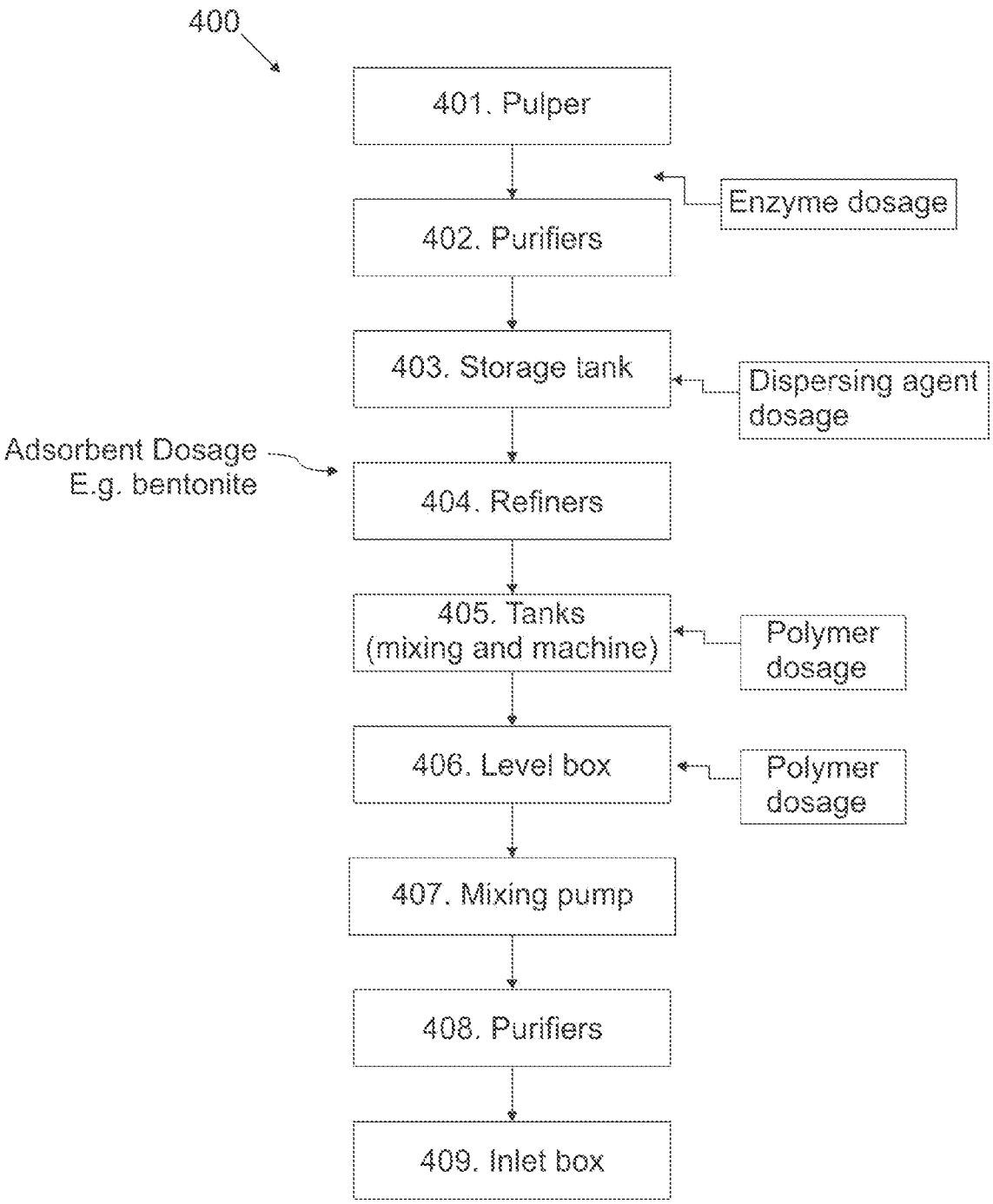
FIG. 4 Prior Art
FIG. 4 shows an illustrative diagram of a typical paper manufacturing process with adsorbent application points (e.g. bentonite), associated and supplementary methods, such as the one proposed in this patent application.

As for the paper manufacturing process 400, in reference to FIG. 4, usually the adsorbent used in the refining phase 404 is already bentonite (replacing talc), due to its beneficial retention and drainage properties, in addition to control of pitch and stickies, in a typical dual system (microparticle+coagulant), which fixing polymers or biopolymers dosed at the mixing and machine tanks 405 or at the level box 406, mainly following the technological concept previously mentioned in WO 03/085199. As previously seen, instead of isolated bentonite, an alternative adsorbent system such as the hydrotalcite+bentonite mix proposed herein may provide beneficial synergic effects to the process. However, this chemical methodology also comprises the alternative use of hydrolytic enzymes between the pulper 401 and purifiers 402, in addition to supplementary dispersing agents at the storage tank 403. Dosage in points further ahead in the machine circuit, more specifically in the inlet box 409, or even in purifiers 408 and mixing pump 407 may be risky, as it does not allow proper residence time for better chemical action prior to sheet formation.

Specifically as shown in FIG. 4, the typical paper manufacturing process 400 comprises, in sequence, a pulper phase 401, followed by a phase in purifiers 402, followed by a storage tank phase 403, followed by a refiner phase 404, mixing and machine tanks 405, level box phase 406, mixing pump phase 407, purifiers phase 408 and, finally, the inlet box phase 409; an enzyme dosing phase between phases 401 and 402 is provided; a dispersing agent dosing phase at phase 403; an adsorbent dosing phase (e.g. bentonite) on phase 404; a polymer dosing phase on phase 405; another polymer dosing phase on phase 406.

It is therefore evident that, in a first aspect of the Invention Patent application, in addition to the special clay mix to be detailed afterwards, that the methodological strategy 100 presented herein is multifaceted and synergic in terms of chemical action, covering the peculiarities of the cellulose 300 and paper 400 manufacturing processes, although it should be noted that variations in the order of application methods and points are possible.

The embodiments provided in this invention Patent application are only possible if, by the main adsorption method 102, a mix of special clays is provided through an application system 500 (flowchart in FIG. 5), more precisely bentonite (clay 1), hydrotalcite (clay 2) and, optionally, a complementary clay 3 or any other chemical provided in the aforementioned methodology which may be a dispersing agent, a polymer, a biopolymer and/or an enzyme. This system essentially comprises a thermodynamic equipment herein called continuous flow shearing chamber 502, in addition to devices for automatic regulation of talc pre-dosing 501 or post-dosage 503, thus providing ideal efficiency modulation of mixed adsorbents, with partial or full talc replacement, depending on the level of dissolved and colloidal contaminants (pitch and stickies) of processes considered and specific retention and drainage goals.

Figure 6:
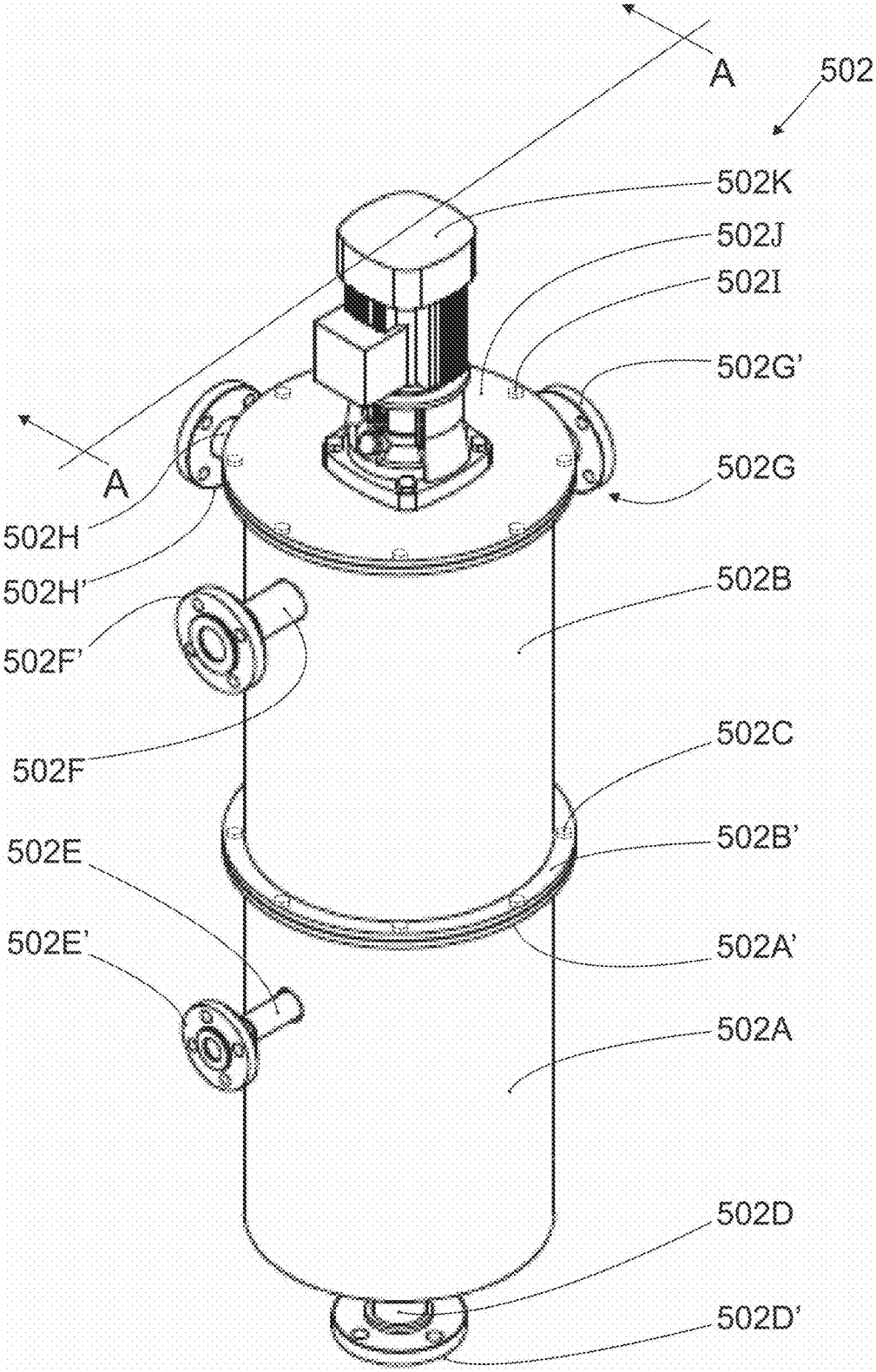
FIG. 6 shows a three-dimensional representation of the continuous flow shearing chamber, an innovative piece of equipment that is also an object of this Invention Patent application.
Figure 7:
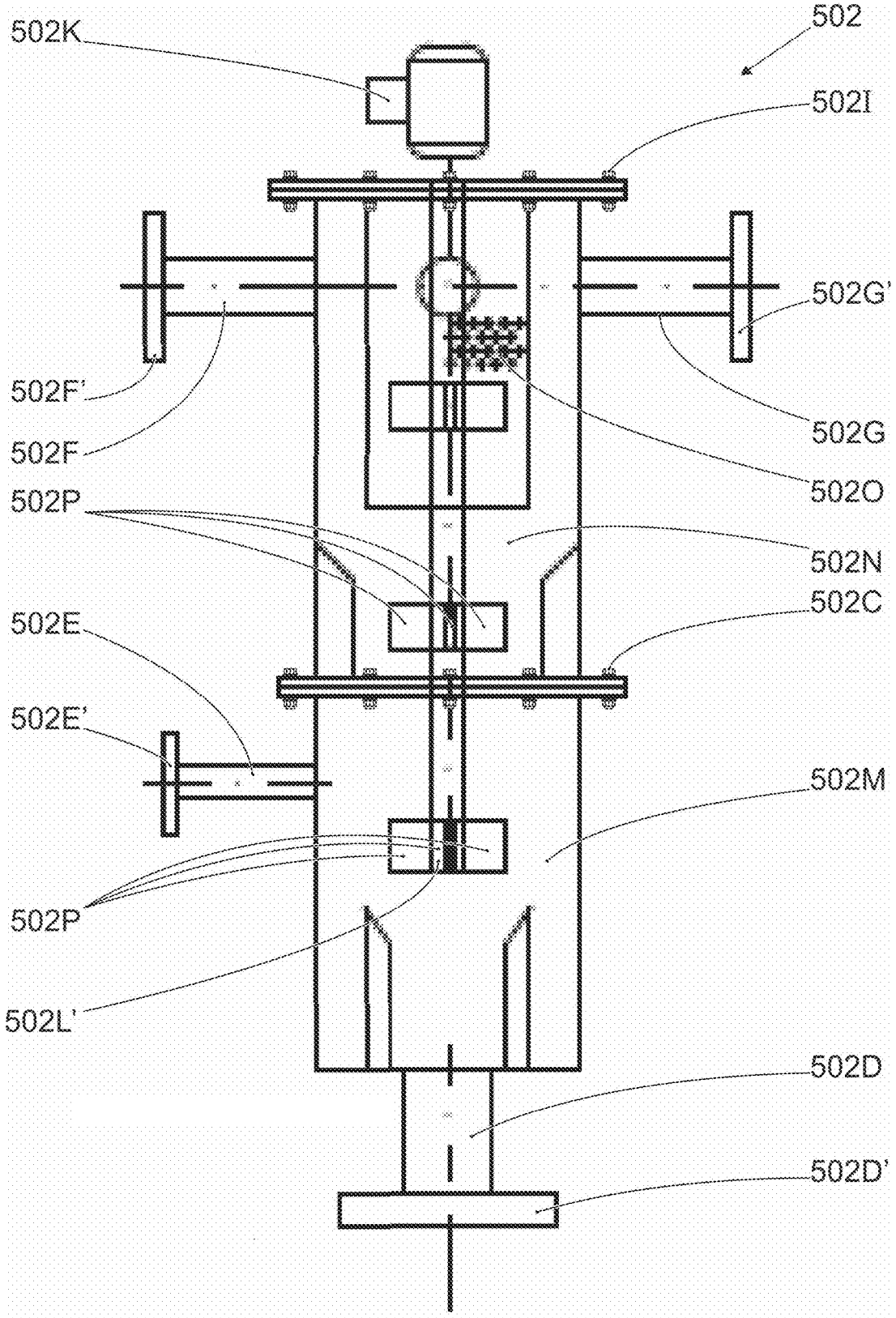
FIG. 7 shows a schematic section view which is taken according to the indication by the "A"-"A" cut line of FIG. 6.
Figure 8:
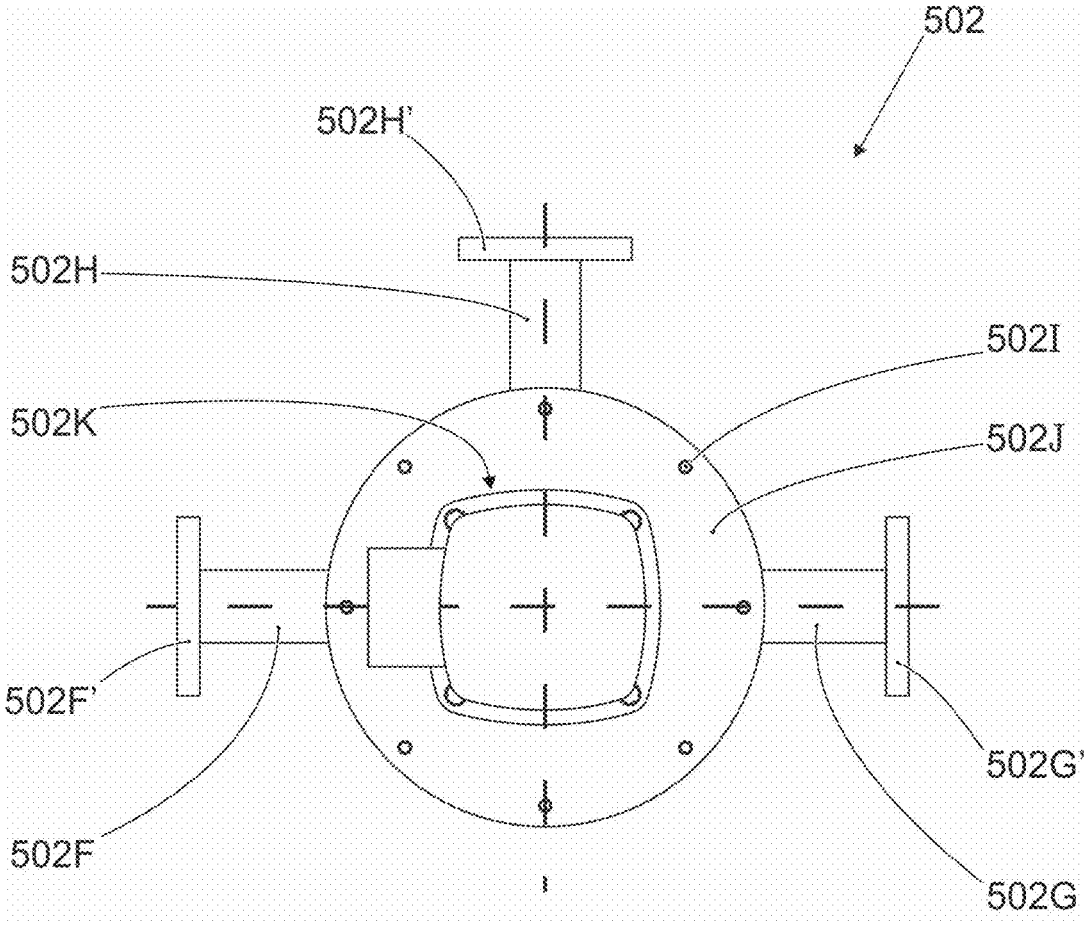
FIG. 8 shows an upper view taken from FIG. 6 that shows the shearing chamber.

Therefore, the mix of talc and substitute clays in the continuous flow shearing chamber 502 may be observed in 3 dimensions on FIGS. 6, 7 and 8 and involves, more particularly, the slurry mix (suspensions above 5%) of bentonite (clay 1) and hydrotalcite (clay 2), with mass ratios that may vary from 1000:1 to 1:1000, ideally between 10:1 to 1:10, in variable pressure conditions by the viscosity of slurries between 10 and 5000 mPa·s, preferably between 200 and 500 mPa·s, and temperature between 40 and 100° C., ideally between 50 and 80° C., reached by high precision pumping with large-sized pumps through which clays are rubbed against each other, favoring delamination and subsequent increase in surface area and exposure of adsorption sites. The talc, which may also enter the continuous flow shearing chamber 502, must uphold the mass relation with the total clay mix at a 1:1000, ratio up to a maximum 1:1 ratio, ideally as low as possible, or even null, which would be the best possible scenario in this invention.

Regarding the continuous flow shearing chamber 502, this is essentially a homogenizing device formed by two pipe sections, a lower section 502A and an upper section 502B, the first comprising a top peripheral assembly flange 502A', whereas the second comprises a corresponding bottom peripheral assembly flange 502B', as both flanges may be joined by screws 502C.

The lower pipe section 502A features an outlet pipeline 502D, axial to the geometric axis of said pipe section, which includes a connecting flange 502D', in addition to a radially positioned side inlet pipeline 502E including a corresponding connecting flange 502E'.

Whereas the upper pipe section 502B comprises a first radially placed side inlet pipeline 502F including a corresponding connecting flange 502F" and a second radially placed side inlet pipeline 502G including a connecting flange 502G", in which the first side inlet pipeline 502F is diametrically opposed to the second side inlet pipeline 502G.

The upper pipe section 502B also comprises a third side inlet pipeline 502H, placed on the same level regarding the first and second side inlet pipelines 502F and 502G, in which said third side inlet pipeline 502H includes a respective connecting flange 502H'.

The upper pipe section 502B features a top peripheral assembly flange 502B" against which a closure disc 502J is assembled through screws 5021.

An electric drive motor 502K is assembled at the center of the closure disc 502J, which drives a vertical shaft 502L which internally traverses both the lower pipe section 502A and the upper pipe section 502B.

Internally, the lower and upper pipe sections 502A and 502B respectively comprise internal chambers, respectively indicated as 502M and 502N.

The internal chamber 502N of the upper pipe section 502B comprises a pipe screen 502O which hangs from the lower face of the closure disc 502J.

The vertical axis 502L comprises three pairs of homogenizing blades 502P along its full length, while the first of three sets of blades 502P is provided inside the tubular screen 502O, and the second set of blades 502N is positioned in the lower section of the chamber 502N of the upper pipe section 502B and, lastly, the third set of blades 502P is placed at the very bottom 502L' of the vertical axis 502L, while said third set of blades 502P is placed in the middle of the internal chamber 502M of the lower pipe section 502A.

Regarding the upper pipe section 502B, the first side inlet pipeline 502F serves as an inlet for "clay 1" (bentonite), while the second side inlet pipeline 502G serves as an inlet for "clay 2" (hydrotalcite), while the third side inlet pipeline 502H serves as an alternate inlet for "clay 3" or other chemicals.

Regarding the lower pipe section 502, its side inlet pipeline 502E aims at allowing the intake of talc.

The material flows entering the continuous flow shearing chamber 502 through its upper pipe section 502B through its first, second and third side inlet pipelines 502F, 502G and 502H, are homogenized by the rotation of the vertical axis 502L and, more specifically, by the rotation of the sets of homogenizing blades 502P, which similarly occurs with the talc flow entering the lower tubular chamber 502A through its side pipe section 502E.

Figure 5:
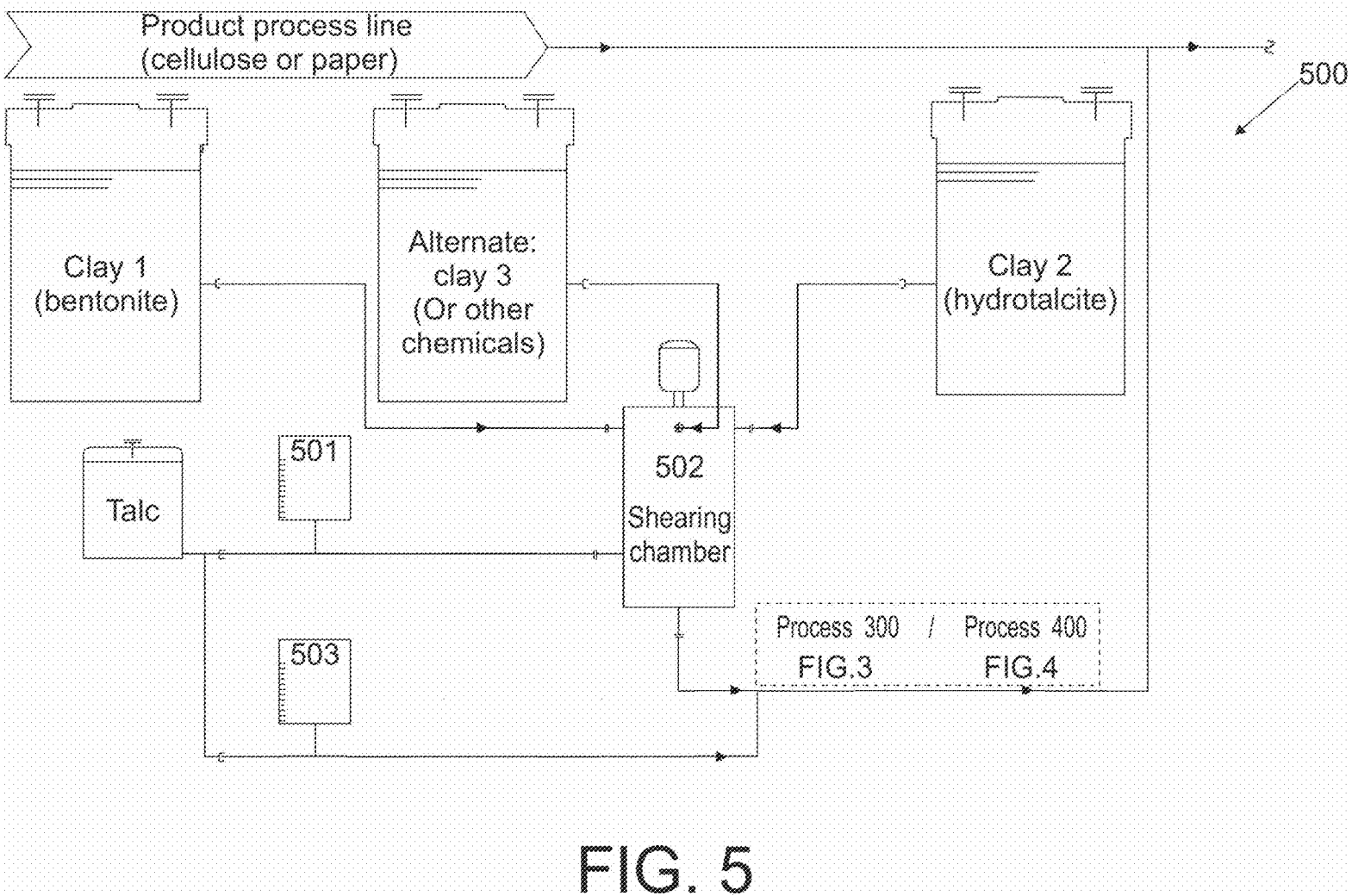
FIG. 5 shows a schematic flowchart of the new continuous treatment system for cellulose pulp.

The homogenized flow entering the continuous flow shearing chamber 502 follows thereof through the outlet pipeline 502D towards the processes 300/400, as schematically shown in FIG. 5.

It should be noted, as previously stated in the technical background, that the clays must be in stabilized slurry form that facilitate pumping for application. Patent PI 0401695 (deriving from Chilean patent CL 2002002155) applies bentonite slurries focused on retention and drainage, but does not explore its mixing with other clays such as hydrotalcite. Similarly, the Chinese patent (CN 101333787) provides the isolated action of hydrotalcite over pitch (no mixing with other clays), as well as any gains in retention and drainage.

It is also known that raw bentonite is often not the most efficient, due to, among other reasons, composition variations inherent to the region from where they are extracted (e.g.: Brazil, Mexico, Greece, Germany, and Morocco). In this sense, this Invention Patent application prioritizes calcitics ones above 60% montmorillonite concentration, ideally between 85 and 95%, as well as those that have undergone a milling process to reach an average particle size lower than 100 μm. This does not mean that sodium bentonites, in natura, or even activated bentonites (e.g. Organophilized) and/or stabilized with various dispersing agents cannot be employed with satisfactory results.

On the other hand, a recent Chinese patent (CN 109331774) has shown that a modified bentonite may be produced by reacting with hydrotalcite in certain temperature and pressure conditions, however, the application of the material obtained herein is limited to removal of heavy materials and dyes, leaving the way open for other applications such as paper machines proposed herein for controlling pitch and stickies, as well as retention and drainage.

In addition to hydrotalcite, which are dual lamellar hydroxides belonging to the anionic clay family, featuring a structural formula comprised of bivalent and trivalent metallic cations, as well as an interleaved anion, other clays may also be used in the continuous flow shearing chamber (clay 3), such as quartz, diatomite, pyrite, mica, sepiolite, cristobalite, pyrophyllite, gypsum, limonite, perlite, vermiculite, dolomite, agalmatolite, among others.

Hydrotalcite employed in the mixes of this invention Patent application may be natural or synthesized through conventional means, such as the co-precipitation method, salt oxide, induced hydrolysis, hydrothermal, among others. The hydrotalcite may feature variations in interlamellar metals and anions, preferably comprising magnesium and aluminum such as cations, and the most common anions are chloride, nitrate, carbonate, and sulfate.

According to what proposed in this Invention Patent application, the mix of clay slurries, more specifically bentonite and hydrotalcite, may fall into proportions that ideally vary between 1:9 and 9:1, considering that the mix of clay slurries takes place preferably under pressure and temperature obtained through pumping conditions.

Lastly, in face of the foregoing advancements, in addition to the particular embodiments described and detailed herein, this Invention Patent application should not be considered limited to such descriptions. Moreover, it should be clear to those skilled in the several arts involved herein that any modifications, whether apparent or not, may be incorporated as an integral part of this invention and yet remain in agreement with the scope of the following claims.

The invention claimed is:

1. A process for contaminants treatment of cellulose pulps, comprising the steps of:

(a) mixing bentonite and hydrotalcite, in a mass ratio between 10:1 to 1:10, at a temperature between 4° and 100° C., thereby forming a slurry mix, wherein overall content of bentonite in the total slurry mix is at least 5%, and the slurry mix has a viscosity between 200 and 500 mPa-s, and (b) contacting cellulose with said slurry mix;

(c) performing a chemical adsorption phase on said slurry mix, wherein wherein the chemical adsorption phase consists of a mix of clays through an application system comprising a continuous flow shearing chamber;

wherein the continuous flow shearing chamber is a homogenizing device formed by a lower pipe section and a higher pipe section, through which inlet and outlet clay pipelines are connected, and;

wherein the lower pipe section includes a top peripheral assembly flange, whereas the higher pipe section comprises a corresponding bottom peripheral assembly flange; the lower pipe section comprises an outlet pipeline that is axial to the geometric axis of said lower pipe section, which includes a connecting flange, in addition to a radially positioned side inlet pipeline including a corresponding connecting flange; while the higher pipe section comprises a first radially placed side inlet pipeline including a corresponding connecting flange and a second radially placed side inlet pipeline including a connecting flange, whereas the first side inlet pipeline is diametrically opposed to the second side inlet pipeline; the higher pipe section also comprises a third side inlet pipeline, placed on the same level regarding the first and second side inlet pipelines and, in which said third side inlet pipeline includes a respective connecting flange; the higher pipe section features a top peripheral assembly flange against which a closure disc is assembled through screws; an electric drive motor is assembled at the center of the closure disc, which drives a vertical shaft which internally traverses both the lower pipe section and the higher pipe section; internally, the lower and higher pipe sections and respectively comprise internal chambers, respectively indicated as and; the internal chamber of the higher pipe section incorporates a tubular screen that hangs from the lower face of the closure disc; the vertical shaft comprises three pairs of homogenizing blades along its full length, while the first of three sets of blades is provided inside the tubular screen and the second set of blades is positioned in the lower section of the chamber of the higher pipe section and, lastly, the third set of blades is placed at the very bottom of the vertical shaft, while said third set of blades is placed in the middle of the internal chamber of the lower pipe section.

2. The process for treatment of cellulose pulps, according to claim 1, wherein the slurry further comprises an ethoxylated fatty alcohols-type dispersant, a polyamide- or cationic polyamine-type fixative, and a lipase- or esterase-type enzyme.

3. The process for treatment of cellulose pulps, according to claim 1, wherein said mixing takes place under pressure conditions of 2 to 15 bar.

4. The process for treatment of cellulose pulps, according to claim 1, wherein the bentonite used is calcitic or sodium type, above 60% montmorillonite concentrations, and milled up to an average particle size of 100 μm.

5. The process for treatment of cellulose pulps, according to claim 1, wherein hydrotalcite is natural or synthesized through co-precipitation, salt oxide, induced or hydrothermal hydrolysis methods, and feature variations in interlamellar metals and anions, being composed of magnesium and aluminum as cations and the anions are chloride, nitrate, carbonate and sulfate.

6. The process for treatment of cellulose pulps, according to claim 1, wherein other clays are used aside from bentonite and hydrotalcite, among which are quartz, diatomite, pyrite, mica, sepiolite, cristobalite, pyrophyllite, gypsum, limonite, perlite, vermiculite, dolomite, or agalmatolite.

7. The process for treatment of cellulose pulps, according to claim 1, wherein the side inlet pipeline from the flow shearing chamber is utilized for the intake of talc.

8. The process for treatment of cellulose pulps, according to claim 1, wherein entrance to the continuous flow shearing chamber occurs by its higher pipe section through its first, second and third side inlet pipelines, and are homogenized by rotation of the sets of blades.

9. The process for treatment of cellulose pulps, according to claim 1, wherein talc flow entering a lower tubular chamber through a side pipe section of the lower tubular chamber is homogenized by rotation of the sets of blades.

10. The process for treatment of cellulose pulps, according to claim 1, wherein homogenized flow entering the continuous flow shearing chamber follows from said flow shearing chamber through the outlet pipeline for dosing in a pulp manufacturing process or paper manufacturing process.

11. The process for treatment of cellulose pulps according to claim 1, wherein talc is either not present or present at no more than 50% of total clay components of said slurry mix.

* * * * *